US008128814B2

(12) United States Patent
Davies et al.

(10) Patent No.: US 8,128,814 B2
(45) Date of Patent: Mar. 6, 2012

(54) POOL SUCTION VALVE

(76) Inventors: Mark Allan Davies, Chermside (AU); Paul Maarten de Groot, Chermside (AU)

( * ) Notice: Subject to any disclaimer, the term of this patent is extended or adjusted under 35 U.S.C. 154(b) by 236 days.

(21) Appl. No.: 12/640,680

(22) Filed: Dec. 17, 2009

(65) Prior Publication Data

US 2010/0155317 A1 Jun. 24, 2010

(30) Foreign Application Priority Data

Dec. 23, 2008 (AU) ..... 2008906595

(51) Int. Cl.
*E04H 4/12* (2006.01)

(52) U.S. Cl. ..... 210/167.1; 4/507

(58) Field of Classification Search ..... 210/167.1, 210/167.15; 4/507
See application file for complete search history.

(56) References Cited

U.S. PATENT DOCUMENTS 3,701,427 A * 10/1972 Howard ..... 210/167.1
4,454,035 A * 6/1984 Stefan ..... 210/117
4,737,279 A * 4/1988 Lewis ..... 210/167.1
4,776,953 A * 10/1988 Frentzel ..... 210/167.15
6,393,628 B1 * 5/2002 Kellogg ..... 4/490
7,052,612 B2 * 5/2006 Kelty ..... 210/744

FOREIGN PATENT DOCUMENTS

WO WO 2004/029386 A1 * 4/2004

* cited by examiner

*Primary Examiner* — Fred Prince

(74) *Attorney, Agent, or Firm* — Kirton McConkie; Evan R. Witt

(57) ABSTRACT

A valve system for insertion between a cleaner hose and a pool suction line is mounted in a wall of the pool or skimmer box and comprises a valve with a gate pivoted in a housing which receives the end of the cleaner hose when the gate is open which is thereby juxtaposed in line with the pool suction line located in the pool wall or skimmer box. The juxtaposed ends of both the cleaner hose and the pool suction line have mating tapers and the valve rotates so that the tapered end of the inserted cleaner hose rotates into sealing engagement with the tapered end of the pool suction line. Further the gate of the valve closes automatically when the cleaner hose is withdrawn.

6 Claims, 4 Drawing Sheets

POOL SUCTION VALVE

FIELD OF THE INVENTION

This invention relates to valves for use with pool devices such as crawling cleaners which are connected to a suction inlet in the wall of the pool or skimmer box.

BACKGROUND OF THE INVENTION

In our International Patent Application PCT/AU2007/001229 we disclose a pool surface skimmer which is retrofitted to an existing pool and which operates over a greater variation in pool surface level than conventional built in skimmer boxes. The use of our retrofitted skimmer means that pools do not have to be topped up as frequently in response to loss of water through evaporation and splashing and one can wait for rain to top up the pool. This is particularly useful where water restrictions are in force.

Our retrofitted skimmer has an inlet at its base to receive a suction cleaner hose which must be closed off when the cleaner is not in use so that the surface skimming action is maintained. At present the only other solution we know of covers the skimmer box well completely with a vacuum or suction plate and the pressure to the suction cleaner is then regulated by having a relief valve online. The relief valves only purpose is to ensure that the suction cleaner hose pipe is not directly attached to the pump as this would generally provide far too much suction to operate most cleaners.

This pressure relief valve leaves the pool owner with a much smaller window of operation as it is generally positioned in the skimmer mouth and needs to be completely submerged to allow the system to operate. Numerous variations on this type of pressure relief valve have proven to be unreliable as they have moving parts that are under pressure such as gates and springs which cause sucking of air and de-priming and which also generate noise.

OBJECT OF THE INVENTION

It is therefore an object of the present invention to provide a valve system which variably connects a pool cleaner hose to the pool suction inlet and automatically closes the inlet when the pool cleaner hose is removed or at least provides a useful alternative to existing connections of cleaners to pool suction lines.

STATEMENT OF THE INVENTION

According to the present invention a valve system for insertion between a cleaner hose and a pool suction line is mounted in a wall of the pool or a skimmer box and comprises a valve with a gate pivoted in a housing which receives the end of the cleaner hose when the gate is open which is thereby juxtaposed in line with the pool suction line located in the pool wall or skimmer box.

Preferably the juxtaposed ends of both the cleaner hose and the pool suction line have mating tapers.

Preferably the valve rotates so that the tapered end of the inserted cleaner hose rotates into sealing engagement with the tapered end of the pool suction line.

Preferably the end of the cleaner hose is a tapered cuff.

Preferably the rotation required for sealing engagement is 90 degrees.

Preferably the gate of the valve closes automatically when the cleaner hose is withdrawn.

Preferably the gate has a tab to rotate it into the open position.

Preferably a slot in the end of the cleaner hose engages a ridge on the inside of the valve housing to ensure correct alignment of the hose with the pool suction line.

BRIEF DESCRIPTION OF THE DRAWINGS

An embodiment of the invention is now described by way of example only with reference to the accompanying drawings in which.

DETAILED DESCRIPTION OF THE INVENTION

Figure 1:
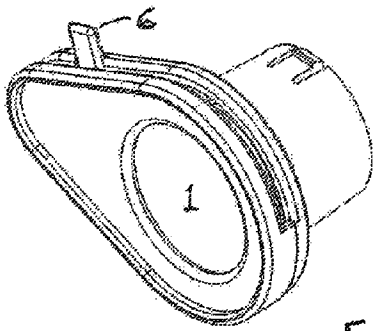
FIG. 1 is an isometric view of a closed gate valve viewed from the right
Figure 2:
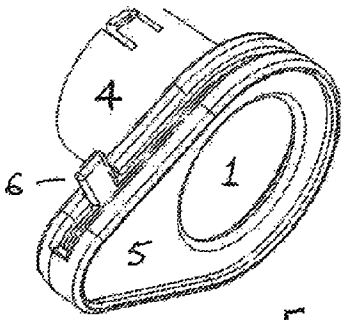
FIG. 2 is an isometric view of the gate valve of FIG. 1 viewed from the left
Figure 3:
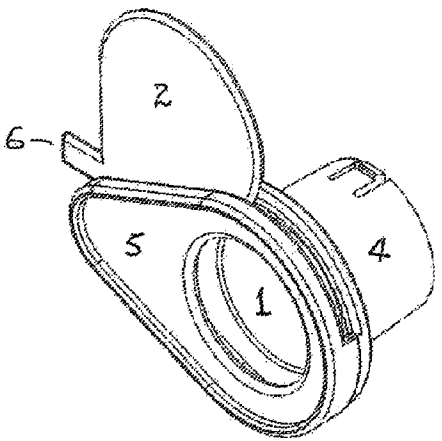
FIG. 3 shows the valve of FIG. 1 with the gate open
Figure 4:
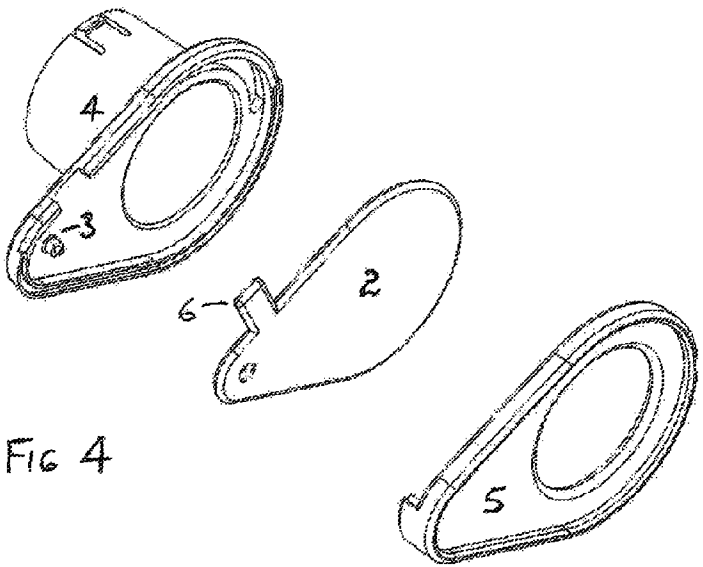
FIG. 4 is an exploded view of FIG. 1

FIGS. 1 to 4 show the construction and operation of gate valve 1 with gate 2 pivoted on pivot 3 between housing 4 and housing 5. To open the valve as shown in FIG. 2 gate 2 is rotated by means of tab 6. When tab 6 is released gate 2 falls into the closed position under gravity.

Figure 5:
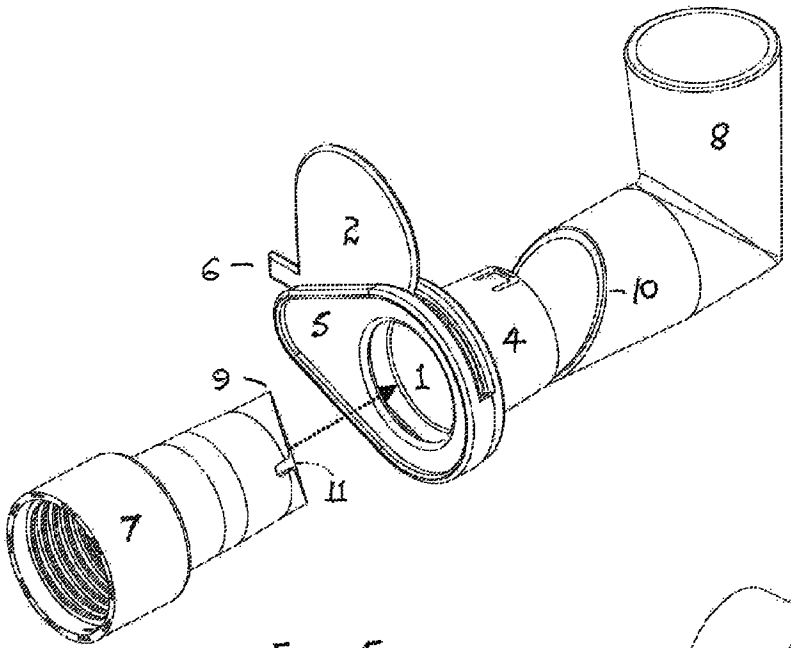
FIG. 5 is an isometric view of a pool cleaner hose being inserted into the open gate valve of FIG. 3 viewed from the right
Figure 6:
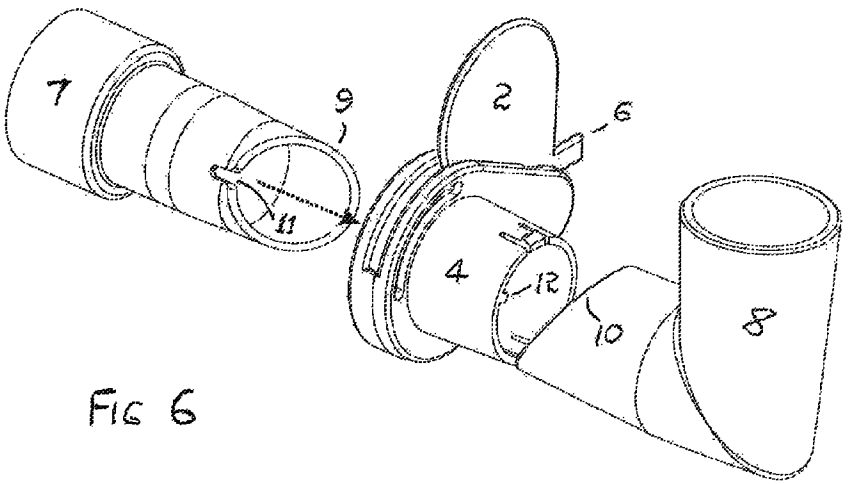
FIG. 6 is FIG. 5 viewed from the left

FIGS. 5 and 6 show cleaner hose cuff 7 being inserted into open gate valve 1 which is rotatably mounted in the front wall of the retrofitted pool skimmer box (not shown) in line with pool suction line 8 at the base of the box. Cuff 7 has tapered end 9 which when fully inserted in open valve 1 protrudes into tapered end 10 of suction line 8.

Slot 11 in cuff 7 engages ridge 12 on the inside of housing 4 to ensure the same engagement between cuff 7 and valve 1. Accordingly, in the position shown in FIGS. 7 and 8 suction line 8 is drawing pool water both through hose 7 and also down from the surface of the pool at the skimmer box.

Figure 8:
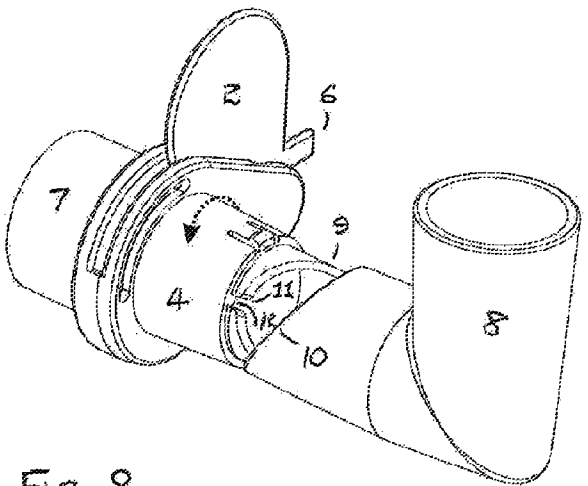
FIG. 8 is FIG. 7 viewed from the left
Figure 7:
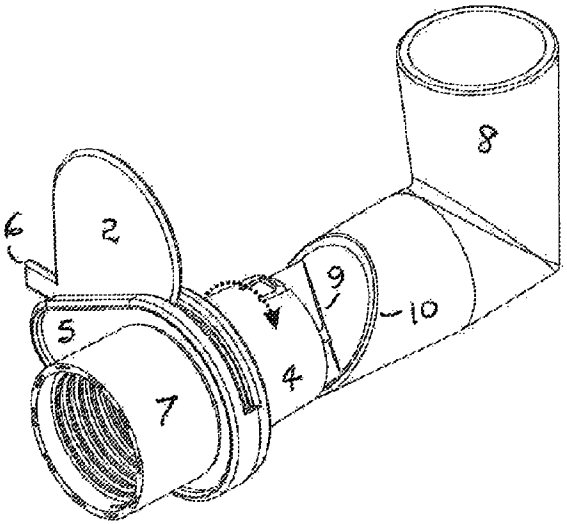
FIG. 7 is an isometric view of the open gate valve and pool cleaner hose partially engaged with the pool suction line viewed from the right
Figure 10:
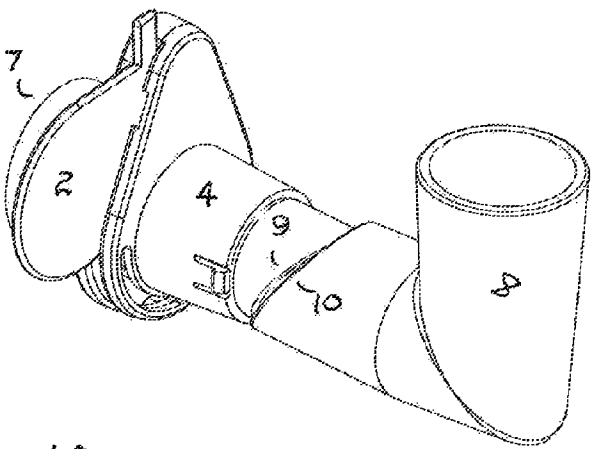
FIG. 9 is an isometric view of the open gate valve and pool cleaner hose fully engaged with the pool suction line viewed from the front and FIG. 10 is FIG. 9 viewed from the rear.
Figure 9:
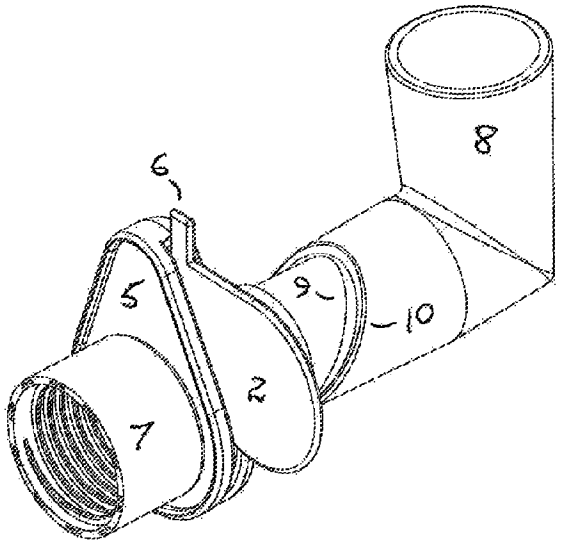

When mated hose 7 and valve 1 are rotated in the skimmer box wall through 90 degrees as shown in FIGS. 7 and 8, tapered cuff 9 of hose 7 rotates into sealing engagement with suction line 8 as shown in FIGS. 9 and 10 and so all the suction is applied to cleaner hose 7 and surface skimming ceases.

Accordingly completely variable biasing of suction to the cleaner is achieved by rotation of valve 1. Alternatively when hose 7 is completely withdrawn from valve 1, gate 2 falls closed and all suction from line 8 is applied to skimming the surface of the pool.

ADVANTAGES

It will be apparent that the valve of the present invention provides an infinitely variable connection between cleaner hose 7 and pool suction line 8 by a simple rotation of hose 7 in valve 1. Accordingly hose 7 can be fully inserted into valve 1 in sealing engagement with tapered end 10 of suction line 8 so that all suction is applied to hose 7.

When hose 7 is withdrawn from valve 1 gate 2 automatically closes thereby ensuring all suction is applied to skimming the pool surface. Further the automatic closing ensures that no part of a swimmer can be sucked into the skimmer box through the valve.

Valve 1 can also be mounted in the wall of the pool to engage the middle leg of a T junction in the pool suction line on its path to the skimmer box. In this application suction to cleaner hose 7 can be adjusted by rotation of valve 1 to provide the required cleaning action while the skimmer box continues to skim the surface of the pool.

VARIATIONS

It will be realized that the foregoing has been given by way of illustrative example only and that all other modifications and variations as would be apparent to persons skilled in the art are deemed to fall within the broad scope and ambit of the invention as herein set forth. Throughout the description and claims of this specification the words "comprise" and variations of that word such as "comprises" and "comprising" are not intended to exclude other additives components integers or steps.

The invention claimed is:

1. A valve system for insertion between a cleaner hose and a pool suction line is mounted in a wall of the pool or skimmer box and comprises a housing with a gate pivoted in the housing which receives an end of the cleaner hose when the gate is open which is thereby juxtaposed in line with the pool suction line located in the pool wall or skimmer box, in which the juxtaposed ends of both the cleaner hose and the pool suction line have mating tapers, and in which the valve rotates in the wall of the pool or skimmer box so that the tapered end of the inserted cleaner hose rotates into sealing engagement with the tapered end of the pool suction line.

2. The system of claim 1 in which the end of the cleaner hose is a tapered cuff.

3. The system of claim 2 in which the gate has a tab to rotate it into the open position.

4. The system of claim 1 in which the rotation required for sealing engagement is 90 degrees.

5. The system of claim 1 in which the gate of the valve closes automatically when the cleaner hose is withdrawn.

6. A valve system for insertion between a cleaner hose and a pool suction line is mounted in a wall of the pool or skimmer box and comprises a housing with a gate pivoted in the housing which receives the end of the cleaner hose when the gate is open which is thereby juxtaposed in line with the pool suction line located in the pool wall or skimmer box in which a slot in the end of the cleaner hose engages a ridge on the inside of the valve housing to ensure correct alignment of the hose with the pool suction line.

* * * * *